US005207838A

United States Patent [19]

Googin et al.

[11] Patent Number: 5,207,838

[45] Date of Patent: May 4, 1993

[54] NONHAZARDOUS SOLVENT COMPOSITION AND METHOD FOR CLEANING METAL SURFACES

[75] Inventors: John M. Googin, Oak Ridge; Ronald F. Simandl, Farragut; Lisa M. Thompson, Knoxville, all of Tenn.

[73] Assignee: Martin Marietta Energy Systems, Inc., Oak Ridge, Tenn.

[21] Appl. No.: 751,912

[22] Filed: Aug. 29, 1991

[51] Int. Cl.[5] ..... C23G 5/024; C23G 5/032; C23G 5/036

[52] U.S. Cl. ..... 134/42; 134/40; 252/542; 252/153; 252/170

[58] Field of Search ..... 252/542, 153, 170; 134/40, 42

[56] References Cited

U.S. PATENT DOCUMENTS

| | | | |
|---|---|---|---|
| 3,167,514 | 1/1965 | Baker | 252/170 |
| 3,538,007 | 11/1970 | Cooper et al. | 252/144 |
| 3,743,542 | 7/1973 | Cooper et al. | 252/170 X |
| 3,751,970 | 8/1978 | Alburger | 252/162 X |
| 3,832,235 | 8/1974 | Cooper et al. | 252/170 X |
| 3,960,742 | 6/1976 | Leonard | 252/90 |
| 4,060,496 | 11/1977 | Berliner | 252/171 |
| 4,120,810 | 10/1978 | Palmer | 252/153 |
| 4,302,348 | 11/1981 | Requejo | 252/135 |
| 4,309,300 | 1/1982 | Danforth et al. | 252/170 |
| 4,435,305 | 3/1984 | Tsoukalas et al. | 252/158 |
| 4,606,840 | 8/1986 | Gautier et al. | 252/171 |
| 4,670,171 | 1/1987 | Magyar | 252/153 |
| 4,673,524 | 1/1987 | Dean | 252/118 |
| 4,734,215 | 3/1988 | Prigge | 252/170 X |
| 4,738,876 | 4/1988 | George et al. | 252/170 X |
| 4,749,509 | 1/1988 | Kacher | 252/139 |
| 4,765,844 | 8/1988 | Merrem et al. | 252/153 |
| 4,808,235 | 2/1989 | Woodson et al. | 134/42 X |
| 4,808,329 | 2/1989 | Soldanski et al. | 252/62 |
| 4,810,411 | 3/1989 | Del Pesco et al. | 252/162 |
| 4,812,255 | 3/1989 | Suwala | 252/170 X |
| 4,822,723 | 4/1989 | Dhillon | 252/170 X |
| 4,824,762 | 4/1989 | Kobayashi et al. | 252/171 X |
| 4,836,950 | 6/1989 | Madsen et al. | 252/542 X |
| 4,854,973 | 8/1989 | Holdar | 252/170 X |
| 4,863,629 | 9/1989 | Osberghaus et al. | 252/162 |
| 4,921,629 | 5/1990 | Malihi et al. | 252/170 |
| 5,024,780 | 6/1991 | Leys | 252/542 X |

*Primary Examiner*—Patrick P. Garvin
*Attorney, Agent, or Firm*—Herman L. Holsopple; Harold W. Adams

[57] ABSTRACT

A solvent composition for displacing greasy and oily contaminants as well as water and/or aqueous residue from metallic surfaces, especially surfaces of radioactive materials so that such surfaces can be wiped clean of the displaced contaminants, water and/or aqueous residue. The solvent composition consists essentially of a blend of nonpolar aliphatic hydrocarbon solvent having a minimum flash point of about 140° F. and 2 to 25 volume percent of a polar solvent having a flash point sufficiently high so as to provide the solvent composition with a minimum flash point of at least 140° F. The solvent composition is nonhazardous so that when it is used to clean the surfaces of radioactive materials the waste in the form of paper or cloth wipes, lab coats and the like used in the cleaning operation is not considered to be mixed waste composed of a hazardous solvent and a radioactive material.

10 Claims, No Drawings

NONHAZARDOUS SOLVENT COMPOSITION AND METHOD FOR CLEANING METAL SURFACES

This invention was made with Government support under contract DE-AC05-84OR21400 awarded by the U.S. Department of Energy to Martin Marietta Energy Systems, Inc. and the Government has certain rights in this Invention.

BACKGROUND OF THE INVENTION

The present invention relates generally to a solvent composition for cleaning organics as well as water or water residue from metallic surfaces, and more particularly to such a solvent composition that is relatively nonhazardous, of low toxicity, and suitable for cleaning surfaces of radioactive materials.

The removal of organic contaminates, usually in the form of oily or greasy films, from surfaces of metallic materials has been previously achieved by using solvents that are now considered to be hazardous. For example, a halogenated hydrocarbon such as trichloroethylene, 1,1,1-trichloroethane, tetrachloroethylene, or 1,1,2-trichloro-1,2,2-trifluoroethane was frequently used as a fire suppressor in combination with a relatively volatile aliphatic hydrocarbon solvent such as nonane for forming a degreasing solvent. Such chlorinated or chlorofluorocarbon solvents have been satisfactorily utilized for some time in both vapor and hand degreasing modes for cleaning surfaces of metallic materials, including radioactive materials. However, relatively recent investigations into the use of these chlorinated or chlorofluorocarbon solvents have shown that they are hazardous and toxic to the health of humans as well as hazardous to the environment such as by causing the unfavorable depletion of the ozone layer about the earth. As a result of such investigations, legislation, notably the Resource Conservation and Recovery Act (RCRA), has resulted in regulations which list such chlorinated and chlorofluorocarbon solvents as being hazardous so as to require the use of special handling, storage, and processing procedures for these solvents and solvent-contaminated waste from cleaning operations.

This invention was made with the support of the U.S. Government under contract No. DE-AC05-84-OR21400 awarded by the U.S. Department of Energy. The U.S. Government has certain rights in this invention.

These regulations have had a significant impact on the use of such metal degreasing solvents especially when they are used to degrease surfaces of radioactive materials in that any waste or residue resulting from the cleaning operation is classified as "mixed" waste since the waste contains both a solvent considered to be hazardous by RCRA regulations and a radioactive material. Under existing conditions, the presence of such mixed waste creates significant handling and storage problems since no facilities have been permitted to process mixed waste. The only presently acceptable procedure for handling mixed waste is to store the waste in limited quantities and space under conditions subject to strict control for possible future processing. Thus, waste in the form of various paper and cloth wipes, coveralls, lab coats, gloves, mop heads and the like used for degreasing surfaces of radioactive materials with a solvent designated as hazardous under RCRA must be handled as mixed waste. Accordingly, due to this mixed waste classification, the use of solvents such as chlorinated and chlorofluorocarbon solvents that are listed as being hazardous under RCRA regulations is no longer considered to be a viable option for cleaning the surfaces of radioactive materials. In fact, the use of such listed solvents for cleaning nonradioactive hard metal surfaces is of questionable value since the residue from such cleaning operations must be treated as hazardous waste and, as such, requires specific handling and processing steps for the storage or disposal of the waste.

Extensive efforts have been conducted in an effort to provide a solvent that is not considered to be hazardous by RCRA regulations for effectively degreasing surfaces of radioactive materials. However, in addition to finding a desirable degreasing solvent which satisfies RCRA regulations there are numerous other requirements that the solvent should possess for acceptance in the work place. Such other requirements dictate that the solvent be characterized by acceptable exposure levels by industrial hygiene standards, relatively low flammability properties, environmental emissions control, acceptable nuclear criticality factor, and high levels of quality control. Also, when attempting to replace chlorinated and chlorofluorocarbon type solvents with nonhazardous solvents which satisfy metal-surface degreasing requirements as provided by the use of highly satisfactory but hazardous, degreasing solvents such as 1,1,1-trichloroethane or 1,1,2-trichloro-1,2,2-trifluoroethane, as well as satisfactorily fulfilling the other solvent requirements noted above, it was found that one additional problem needed to be addressed. For example, the machining of radioactive materials such as uranium and uranium alloys is usually achieved with aqueous-based machining coolants and lubricants. Also, the surfaces of such materials are frequently rinsed with water or aqueous solutions after the machining operation. The presence of residual quantities of such aqueous solutions and/or water on the surfaces of uranium and uranium alloys following machining are undesirable since such residual aqueous solutions or water will promote uneven corrosion and staining of the machined surfaces. Corresponding corrosion and staining problems will also be present on the surface of other hard metals which utilize aqueous machining lubricants and coolants and/or the rinsing of machined surfaces with water or aqueous solutions. Thus, an acceptable relatively nonhazardous solvent should provide desirable degreasing properties as well as the capability of undercutting and displacing water from the metal surfaces.

SUMMARY OF THE INVENTION

Therefore, it is a primary aim or objective of the present invention to provide a solvent composition for displacing the organic contaminates, primarily in the form of an oily and greasy film as well as water and aqueous solution residues from surfaces of metallic materials, especially radioactive materials such as uranium and uranium alloys. This solvent composition is characterized as being nonhazardous under RCRA regulations and by providing metallic surfaces that are essentially as clean as those provided by the use of hazardous chlorinated or chlorofluorocarbon solvents such as 1,1,1-trichloroethane or 1,1,2-trichloro-1,2,2-trifluoroethane. Such a nonhazardous solvent composition eliminates the problems associated with the storing of the aforementioned mixed wastes by reducing the undesirable mixed waste classification of the combined solvent and radioactive material waste resulting from the cleaning of radioactive material to that of low-level radioactive waste which can be handled, stored, and reprocessed by acceptable practices.

Another object of the present invention is to provide a nonhazardous solvent composition that is substantially nontoxic to the user and which is highly effective for cleaning organic contaminates and water from metal surfaces, including surfaces of radioactive metals, by wiping solvent-wetted metal surfaces with a paper or cloth wipe.

A further object of the present invention is to provide a method for cleaning surfaces of metals, especially radioactive metals, of organic surface contaminates such as oils and greases, as well as any water or residue from aqueous solutions from such surfaces by employing a novel, nonhazardous water-displacing and degreasing solvent composition.

A still further object of the present invention is to provide a halogen-free solvent composition that is characterized by possessing a minimum flash point of 140° F. so as to be considered nonhazardous under the regulations of the RCRA.

A still further object of the present invention is to provide a liquid solvent composition formed of a blend of two solvents that has solubility parameters acceptable for cleaning oily and greasy residue from metal surfaces while simultaneously undercutting and displacing water and aqueous residue from such metal surfaces.

Generally, the nonhazardous water-displacing solvent composition of the present invention for cleaning organic contaminates from metal surfaces is substantially nonaromatic and consists essentially of a major concentration of a nonpolar aliphatic hydrocarbon solvent having a boiling point of at least about 170° C. and flash point of at least about 140° F., and a polar solvent having sufficient polarity and in a concentration adequate to impart water displacing characteristics to the solvent composition and characterized by possessing a flash point at a temperature that will not lower the flash point of the solvent composition to less than 140° F. in the concentration of polar solvent utilized. Polar solvent concentrations of about 2 to 25 volume percent of the solvent composition, preferably about 2 to 10 volume percent, have been found to satisfactorily undercut water and aqueous residue on the surfaces of hard metals, especially radioactive metals and alloys such as uranium and uranium alloys.

The method for cleaning a metal surface for the removal of any organic contaminants, water, and aqueous residue comprises the steps of contacting the metal surface with a solvent composition that is substantially free of aromatic components and which consists essentially of a blend of a nonpolar aliphatic hydrocarbon solvent and about 2 to 25 volume percent of a polar solvent, and wiping from the metal surface substantially all of the solvent composition and any organic contaminants, water, and aqueous residue displaced from the metal surface by the solvent composition. In the solvent composition, the aliphatic hydrocarbon solvent is characterized by a major concentration of a hydrocarbon having at least eleven carbon atoms, a boiling point in a narrow boiling range in a temperature range of about 170° to about 250° C., a vapor pressure of at least 0.4 mm mercury at room temperature, and a minimum flash point of about 140° F. The polar solvent in the solvent composition is selected from an alcohol, ether, pyrrolidone, carbonate, glycol, glycol ether, or a mixture thereof that is characterized by a sufficiently high polarity to displace water and aqueous residue from the metal surface and by possessing a flash point sufficiently high to provide the solvent composition with a minimum flash point of 140° F. This method is especially suited for cleaning surfaces of radioactive material.

Other and further objects of the present invention will become obvious upon an understanding of the illustrative embodiment and method about to be described or will be indicated in the appended claims, and various advantages not referred to herein will occur to one skilled in the art upon employment of the invention in practice.

DETAILED DESCRIPTION OF THE INVENTION

In accordance with the present invention as briefly described above, novel solvent compositions have been found which can be used to effectively remove organics in the form of oily and greasy films as well as water and films of aqueous solutions from the surface of hard metals, especially radioactive metals and alloys, while meeting or exceeding minimum boiling points and flash points required of solvents to be considered nonhazardous by RCRA regulations.

While the solvent compositions of the present invention are particularly suitable for the degreasing and the displacing of water and/or aqueous residue from the surfaces of radioactive materials, it is to be understood that the following description is not intended to be limited to the use of the solvent compositions to the cleaning of surfaces of radioactive material since the nonhazardous solvent compositions of the present invention can be satisfactorily used to clean hard metal surfaces without producing a waste requiring special handling, storage, and processing procedures such as would be involved by employing a solvent listed as hazardous under RCRA regulations.

The nonhazardous and substantially nontoxic solvent compositions each consists essentially of a two-component homogeneous blend of a nonpolar aliphatic hydrocarbon that is particularly characterized by having a minimum flash point of about 140° F. and a polar solvent of a sufficient polarity and of sufficient concentration in the solvent blend to undercut and displace water and films of aqueous solutions from the surface of a hard metal. The polar solvent component is also characterized by having a flash point that is at a sufficiently high temperature so as to maintain the flash point of the solvent composition at a temperature of at least 140° F. These solvent compositions are characterized by being nonflammable and nonreactive when contacting uranium and uranium alloys.

The aliphatic hydrocarbon component of each solvent composition is of the type that is characterized by: a narrow boiling range within a temperature range of about 170° to 250° C.; a minimum flash point of about and preferably equal to or exceeding 140° F.; Hansen solubility parameters of about 16.0, 0, 0 MPa$^{\frac{1}{2}}$, which substantially correspond to those of trichloroethane (17.0, 4.3, 2.1) or 1,1,2-trichloro-1,2,2-trifluoroethane (14.7, 1.6, 0); nonaromatic or containing less than about 5 percent of an aromatic constituent; a threshold limit value of about 100 ppm; and, a vapor pressure of at least 0.4 mm mercury at room temperature. Aliphatic hydrocarbons which satisfy these criteria include petroleum distillates which have 11 to 13 carbon atoms such as dodecane (boiling point 216° C., flash point 160° F.), 6-dodecene (boiling point 213° C., flash point 172° F.), undecane (boiling point 196° C., flash point 140° F.), 2- and 3-methyl undecane (boiling point 232° C., flash point 150° F.), 2-methyl-(4 or 5)-undecene (boiling range 204°-206° C., flash point 162° F.), and trimethyl decane (boiling point 227° C., flash point 140° F.).

In addition to the aforementioned aliphatic hydrocarbons, there are several commercially available solvent blends which have primary components of aliphatic hydrocarbons and which have narrow boiling ranges, which are substantially free of aromatics, and which have minimum flash points of at least 140° F. that would satisfy the requirements for forming solvent compositions in accordance with the present invention. For example, the Ashland Solvent 140-66, Chemical Abstracts Registry No. 64742-88-7, available from the Ashland Oil Co., Columbus, Ohio, has a boiling point of 179° C. and a flash point of 140° F. The Exxon Isopar-L solvent, available from the Exxon Corporation, Houston, Tex., has a narrow boiling range of 188°-206° C. and a flash point of 142° F. The Amsco 140 solvent, available from Union Chemicals Division of Union Oil Company of California, has a narrow boiling range of 182°-193° C. and a flash point of 145° F.

The aliphatic hydrocarbon solvent component of the solvent composition as provided by any of the above described aliphatic hydrocarbons or any of the commercially available solvents noted above is nonpolar and effectively dissolves oily and greasy films on surfaces of hard metals so that the surfaces can be wiped clean of the oily and greasy residue by employing a paper or cloth wipe in much the same manner as previously accomplished with the hazardous chlorinated or chlorofluorocarbon solvents. The aliphatic hydrocarbon solvent component evaporates from the wiped metal surfaces at a relatively slow rate which substantially corresponds to the evaporation rate of kerosene. The use of an aliphatic hydrocarbon solvent with an evaporation rate slower than about that of kerosene would probably be undesirable from a production standpoint for the cleaning of metallic surfaces.

The polar solvent component of the solvent composition according to the present invention is the water removing portion of the solvent composition and has sufficient polarity in the particular concentration used to wet out on metal surfaces and displace water from the metal surfaces such as would deposit on the surfaces by machining and/or surface cleaning with water or an aqueous solution or dispersion. In the cleaning of uranium and uranium alloy surfaces that have been contacted with water or an aqueous solution, the polar solvent component undercuts and displaces the water or the aqueous solution from the surface so that essentially all, if not all, of the water or aqueous solution may be readily wiped from the surface and thereby significantly inhibiting or preventing uneven corrosion or staining of the surface. The polar solvent is also preferably a degreasing-type solvent which has a boiling point and vapor pressure sufficiently high so as to prevent lowering the flash point of a solvent composition containing the polar solvent to a temperature below 140° F. Various long chain alcohols as well as ethers, pyrrolidinones, carbonates, and glycol ethers have satisfactory water-displacing and degreasing properties and have boiling points and vapor pressures sufficiently high so as to satisfactorily function as the polar solvent component of solvent composition. Esters are not desirable in general because of problems associated with volatile and reactive hydrolysis products. Preferably, the polar solvent component should have evaporation characteristics which substantially correspond to that of the aliphatic hydrocarbon component or which will not excessively increase or decrease the evaporation rate of the solvent composition over approximately that of kerosene.

The concentration of the polar solvent component in the solvent composition is such that there is sufficient polar solvent present to wet out and displace all or essentially all of the water or aqueous residue on the metal surfaces, especially surfaces of radioactive materials such as uranium and uranium alloys, that are being cleaned by the solvent composition. Satisfactory results have been achieved by employing the polar solvent in a concentration in the range of about 2 to about 25 volume percent of the blend forming the solvent composition. With a solvent composition having a polar solvent component providing less than about 2 volume percent of the solvent composition there is an insufficient concentration of the polar solvent present to effectively undercut and displace the water from the metal surfaces being cleaned. On the other hand, with a solvent composition containing greater than about 25 volume percent of the polar solvent component, the normally water repelling solvent composition would attract water and thereby inhibit the overall water displacing function of the solvent composition.

With the polar solvent component in the aforementioned concentration, in a blend with any of the aforementioned aliphatic hydrocarbon solvent components, a nonhazardous solvent composition with a minimum flash point of 140° F. can be provided by using a polar solvent selected from such solvents as 1-hexanol, N-methyl-2-pyrrolidinone, 1,2-propanediol, propylene carbonate, ethylene glycol, diethylene glycol dimethyl ether (diglyme), ethylene glycol monobutyl ether, tripropylene glycol monomethyl ether, dipropylene glycol dimethyl ether, and dipropylene glycol monomethyl ether. Each of these polar solvents has a satisfactory boiling point, a flash point above 140° F., and is not listed as hazardous under the RCRA. However, the ethylene glycol series of solvents have been found to be somewhat toxic and preferably should not be used in work places where the toxicity of the solvent composition to the user may be a problem.

Another requirement of the polar solvent is that it possess relatively high stability towards hydrolysis. For example, in cleaning the surface of uranium and uranium alloy articles, the use of polar solvents, particularly esters, which can hydrolyze to a higher molecular weight than that of acetic organic acids should be avoided since the use of such a solvent may form a film of essentially insoluble soap on the surface of the uranium or uranium alloy articles. In addition, esters may also hydrolyze to form volatile, flammable products. Also, solvents such as ketones that are absorbed by uranium or those which strongly complex with uranium should not be used for the surface cleaning of uranium or uranium alloys.

The selection of the particular polar solvent to be blended with a particular aliphatic hydrocarbon solvent component is not critical when the flash point of the individual components is at a temperature of 140° F. or greater so that the solvent blend is provided with a minimum flash point of at least 140° F. However, it is within the scope of the present invention to provide a nonhazardous solvent composition from an aliphatic hydrocarbon solvent component which has a flash point greater than 140° F. and a polar solvent component which has a flash point less than about 140° F., which, when blended together, provide a solvent composition that has a minimum flash point of at least 140° F. Alternatively if the polar solvent has a flash point substantially greater than 140° F., such as in the case of some aforementioned specific polar solvents and is used in the higher concentrations of the solvent composition, then any of these particular polar solvents could be blended with an aliphatic hydrocarbon solvent component having a flash point slightly less than 140° F. to provide a solvent composition having a minimum flash point of at least 140° F. Of course, when providing such blends, care should be exercised to assure that the use of a solvent component with a flash point less than 140° F. in the solvent composition does not result in a solvent composition where that particular solvent component will flash from the solvent composition at a temperature less than 140° F.

In a preferred embodiment of the solvent composition of the present invention, the solvent composition is provided by forming a blend of 97 to 93 volume percent of an aliphatic hydrocarbon component primarily of undecane and 3 to 7 volume percent of dipropylene glycol monomethyl ether. The aliphatic hydrocarbon component used is the aforementioned commercially available Ashland Solvent 140-66 that is composed primarily of 2,3,5-trimethyl decane, 2,6,8-trimethyl decane, 4 isomers of methyl undecane, pentylcyclohexane, 2 isomers of methyl decane, and decaline. This aliphatic hydrocarbon solvent component has a narrow boiling range of 179°-180° C. and a flash point of 140° F. The dipropylene glycol monomethyl ether has a flash point of 167° F. and a boiling point of essentially 179° C.

The preferred solvent composition, containing 5 volume percent of the polar solvent component, when used to degrease and dewater uranium surfaces by wiping with paper wipes was found to leave the machined surfaces as clean as those similarly cleaned by using either 1,1,1-trichloroethane or 1,1,2-trichloro-1,2,2-trifluoroethane. X-ray photoelectron spectroscopy was used to determine levels of surface cleanliness, with the ratio of the carbon peak height (284 eV binding energy) to the base metal peak height serving as the measure of surface cleanliness. Also, cleanliness ratios found to be provided on various nonradioactive hard surfaces by using this solvent composition were typically as low as those found following degreasing with 1,1,1-trichloroethane or 1,1,2-trichloro-1,2,2-trifluoroethane.

Since the solvent compositions of the present invention do not possess the materials or the properties so as to be listed as hazardous under RCRA, any of these solvent compositions or solvent-contaminated waste containing any of these solvent compositions can be disposed of or otherwise treated as sanitary waste. Thus, by using such a nonhazardous solvent composition for cleaning radioactive materials any waste material such as wipes, gloves, lab coats, mop heads, etc. that are or may be contaminated with residue from radioactive material being cleaned and the solvent composition no longer constitute mixed waste and thus can be treated as economically recoverable uranium waste or stored as low level radioactive waste. Even though the solvent compositions are combustible (class IIIA), they nevertheless are not considered to be highly flammable materials under the fire codes and, therefore, do not require the retrofitting of production areas with expensive, explosion proof electrical fixtures, such as would be required by the OSHA standards for the use of materials of greater volatility or combustibility. Although not a nuclear poison, the solvent compositions do not present any greater problems than water when placed in contact with uranium or uranium alloys. Paper wipes that are slightly less than saturated with the solvent composition are not compactable to a density beyond about one-third the density of water so as to lessen any criticality hazard and control problems associated with the use of the solvent composition of the present invention for cleaning radioactive material.

It will be seen that the relatively nontoxic and nonhazardous solvent compositions of the present invention provide degreasing and water chasing properties essentially as good as the toxic, hazardous, and ozone-depleting chlorinated and chlorofluorocarbon solvents heretofore utilized for cleaning surfaces of radioactive metals and alloys. By employing these halogen-free solvent compositions, which have flammability characteristics of greater than 140° F. and thus not listed as hazardous under the RCRA, for cleaning of surfaces of radioactive materials any waste material resulting from the cleaning operation can be simply stored or processed as low-level radioactive waste.

What is claimed is:

1. A nonhazardous water-displacing organic solvent composition for displacing organic contaminates, water and aqueous residue from metal surfaces including radioactive metals and alloys, said solvent composition consisting essentially of a major concentration of a nonpolar aliphatic hydrocarbon solvent having a major component with at least 11 carbon atoms, a boiling point in a narrow boiling range of about 170° C. to about 250° C., a minimum flash point of at least 140° F., a vapor pressure greater than 0.4 mm mercury at room temperature, and containing less than about 5 volume percent of an aromatic component, and the balance of the solvent composition provided by about 2 to 25 volume percent of a polar solvent of a sufficient polarity to impart water displacing characteristics to the solvent composition and with said polar solvent being characterized by possessing a flash point at a temperature that will not lower the flash point of the solvent composition to a temperature less than 140° F. in the concentration of the polar solvent utilized in the solvent composition.

2. A nonhazardous, water-displacing organic solvent composition as claimed in claim 1, wherein the aliphatic hydrocarbon solvent substantially comprises undecane, dodecene, undecane, 2,3-methyl undecane, methyl undecene, trimethyl undecane, or mixtures thereof.

3. A nonhazardous, water-displacing organic solvent composition as claimed in claim 1, wherein the polar solvent is characterized by having a minimum flash point of 140° F. and is selected from the group consisting of alcohols, ethers, pyrrolidinones, carbonates, and mixtures thereof having a minimum flash point of 140° F.

4. A nonhazardous, water-displacing organic solvent composition as claimed in claim 3, wherein the polar solvent having a minimum flash point of 140° F. is selected from the group consisting of 1-hexanol, N-methyl-2-pyrrolidinone, propylene glycol, propylene carbonate, ethylene glycol, diethylene glycol, triethylene glycol, diethylene glycol dimethyl ether, ethylene glycol monobutyl ether, tripropylene glycol monomethyl ether, tripropylene glycol dimethyl ether, dipropylene glycol monomethyl ether, diethylene glycol monobutyl ether, and mixtures thereof.

5. A nonhazardous, water-displacing organic solvent composition as claimed in claim 1, wherein the polar solvent is in a concentration of about 2 to about 10 volume percent of the concentration.

6. A nonhazardous, water-displacing organic solvent composition as claimed in claim 5, wherein the aliphatic hydrocarbon solvent is substantially formed of undecane, and wherein the polar solvent is dipropylene glycol monomethyl ether.

7. A method for cleaning a surface of a metal including a radioactive metal or alloy by the removal therefrom organic contaminants, water and aqueous residue b y the steps which comprise contacting the metal alloy surface with a water-displacing solvent composition consisting essentially of a blend of a nonpolar aliphatic hydrocarbon solvent and about 2 to about 25 volume percent of a polar solvent, said aliphatic hydrocarbon solvent being substantially free of aromatic components and having a major component with at least eleven carbon atoms, a boiling point in a narrow boiling range in a temperature of about 170° to about 250° C., a minimum flash point of at least 140° F., and a vapor pressure greater than about 0.4 mm mercury at room temperature, said polar solvent being selected from the group consisting of alcohol, ether, pyrrolidinone, carbonate, and mixtures thereof that are characterized by possessing a flash point at a sufficiently high temperature so as to provide the solvent composition with a minimum flash point of 140° F., and wiping from said metal surface substantially all of the solvent composition and any of said organic contaminants, water and aqueous residue contacted and displaced from said metal surface by the solvent composition.

8. A method for cleaning a metal surface as claimed in claim 7, wherein the solvent composition consists essentially of a blend of an aliphatic hydrocarbon solvent of substantially undecane and about 2 to 10 volume percent of a polar solvent provided by dipropylene glycol monomethyl ether.

9. A method for cleaning a metal surface as claimed in claim 7, wherein the aliphatic hydrocarbon solvent substantially comprises undecane, dodecene, undecane, 2,3-methyl undecane, methyl undecene, trimethyl undecane, or mixtures thereof.

10. A method for cleaning a metal surface as claimed in claim 7, wherein the polar solvent having a minimum flash point of 140° F. is selected from the group consisting of 1-hexanol, N-methyl-2-pyrrolidinone, propylene glycol, propylene carbonate, N-ethylene glycol, diethylene glycol, triethylene glycol, diethylene glycol dimethyl ether, ethylene glycol monobutyl ether, tripropylene glycol monomethyl ether, tripropylene glycol dimethyl ether, dipropylene glycol monomethyl ether, diethylene glycol monobutyl ether, and mixtures thereof.

* * * * *